United States Patent [19]

Willis

[11] Patent Number: 4,511,169

[45] Date of Patent: Apr. 16, 1985

[54] SELF LOCKING AND UNLOCKING ELEVATOR ASSEMBLY

[75] Inventor: Clyde A. Willis, Wichita Falls, Tex.

[73] Assignee: Walker-Neer Manufacturing Co., Inc., Wichita Falls, Tex.

[21] Appl. No.: 430,943

[22] Filed: Sep. 30, 1982

[51] Int. Cl.[3] ..... B66C 1/64

[52] U.S. Cl. ..... 294/116; 294/110.1

[58] Field of Search ..... 294/116, 101, 102 A, 294/88, 115, 118, 100, 110, 90; 24/242, 232, 251, 243, 248; 74/99 R

[56] References Cited

U.S. PATENT DOCUMENTS

| | | | |
|---|---|---|---|
| Re. 26,284 | 10/1967 | J.V. O'Neill et al. | 175/57 |
| 3,955,249 | 5/1976 | Shiozaki | 294/116 |
| 4,013,178 | 3/1977 | Brown et al. | 294/102 |
| 4,303,270 | 12/1981 | Harold L. Adair | 294/88 |
| 4,314,611 | 2/1982 | Clyde A. Willis | 173/57 |

*Primary Examiner*—James B. Marbert

*Attorney, Agent, or Firm*—Willian Brinks Olds Hofer Gilson & Lione

[57] ABSTRACT

A self locking and unlocking elevator for use with drill pipe is disclosed which, in a specific embodiment, includes a cam body which defines two symmetrically positioned cam surfaces. Each of these cam surfaces serves to support the upper end of a respective jaw, the lower end of which is shaped to clamp and hold the box end of a length of drill pipe. A collar is disposed around the jaws and is mechanically interlocked with the jaws such that both the collar and the jaws are suspended from the cam body. A plate is positioned below the collar above the box end of a clamped length of drill pipe and is secured to the cam body so as to move between a lower position in which the collar and jaws hang from the cam body, and an upper position in which the jaws are supported via the collar and the plate by the box end of the clamped drill pipe. The jaws are shaped such that they move by force of gravity to a closed clamping position when suspended from the cam body, and they open to release the drill pipe when supported by the movable plate.

24 Claims, 10 Drawing Figures

SELF LOCKING AND UNLOCKING ELEVATOR ASSEMBLY

BACKGROUND OF THE INVENTION

This invention relates to an improved elevator assembly adapted for use with a well drilling apparatus in order to lift drilling tubulars quickly and efficiently.

In a wide variety of well drilling operations, it is necessary to assemble a drill string from a large number of individual lengths of drill pipe as a borehole is being drilled. When it becomes necessary for any reason to remove the drill string from the borehole, as for example to replace a worn drill bit, the drill string must be progressively raised as successive lengths of drill pipe are brought to the surface and removed from the drill string. Well servicing requires similar equipment, which, in smaller sizing, is used to pull or replace sucker rods, production piping, etc., for pump service, replacement of worn pipes or rods, or during well cleanout to improve production.

One type of drilling apparatus in wide-spread use utilizes a power swivel which is threadedly coupled to the uppermost length of drill pipes and then used to raise the drill string and to remove the uppermost length of drill pipe from the string. Once this has been accomplished, the threaded connection between the power swivel and the uppermost length of drill pipe is broken, and means such as a transfer arm can then be used to move the length of drill pipe from the vertical position aligned with the borehole to a horizontal position at ground level.

This prior art approach to raising a drill string and successively removing lengths of drill pipe from the string is not entirely acceptable. It requires that the power swivel be threadedly coupled to each successive length of drill pipe, and that this threaded connection then be broken. These repeated threading and unthreading operations can significantly slow the rate at which drill pipe can be removed from a borehole. In addition, these threading and unthreading operations can cause undesirable wear on the threaded connections of the swivel and of the drill pipe.

It is therefore an object of this invention to provide an improved apparatus useful in removing drill pipe from a borehole, and in particular to provide such an apparatus which does not require threaded connections between the apparatus and the drill pipe, and which can be used to speed the rate at which drill pipe can be removed from a borehole.

SUMMARY OF THE INVENTION

According to this invention, there is provided generically an elevator for drill pipe, comprising:

(a) at least two jaws, each jaw having a clamping surface shaped to support a length of pipe;

(b) pivot means for urging the clamping surfaces of the jaws into contact with a length of pipe to be elevated, when the ends of the jaws distant from the clamping surfaces are urged away from the pipe;

(c) elevator suspension and jaw activating means for suspending the elevator, for urging the ends of the jaws distant from the clamping surfaces away from the pipe, and in conjunction with the pivot means, for urging the clamping surfaces into contact with the pipe, when the elevator suspension and jaw activating means and the pipe are urged away from each other; and (d) release means for urging the clamping surfaces away from the pipe when the elevator suspension and jaw activating means and the pipe are urged toward each other.

The elevator is preferably so configured that upon lowering the elevator upon a vertical length of drill pipe held within the jaws of the elevator, the release means automatically urges the clamping surfaces away from the pipe, whereby to release the pipe. The elevator is preferably further so configured that upon raising the elevator with a vertical length of drill pipe held within the jaws of the elevator, the elevator suspension and jaw activating means automatically urges the clamping surfaces toward the pipe, whereby to clamp firmly onto the length of drill pipe. The elevator is preferably further so configured that upon raising the release means when no drill pipe is held within the jaws, the jaws open to receive a length of drill pipe. In this way, the present invention provides an elevator for drill pipe which is self locking (by lifting the elevator which holds a pipe) and self unlocking (by lowering the elevator which holds the pipe, whereby to activate the release means).

More specifically, the present invention provides an automatically operating elevator for drill pipe, which includes a cam body (the elevator suspension and jaw activating means) which defines at least two spaced cam surfaces. At least two jaws are arranged to hang from the cam surfaces. Each of the jaws defines an upper support surface in contact with a respective one of the cam surfaces and a lower surface shaped to support a length of pipe such as drill pipe. A collar (the pivot means) is disposed around the jaws and is mechanically interlocked with the jaws such that both the collar and the jaws can be suspended from the cam body and yet the jaws are pivotable with respect to the collar. The collar and jaws are configured such that the weight of the collar tends to close the jaws to grip a length of pipe positioned therebetween. In addition, means (the release means) are provided for raising the collar with respect to the cam body to cause the jaws to open automatically in order to release a length of pipe clamped between the jaws.

As described below in connection with a preferred embodiment, the preferred elevator of this invention includes jaws which are so shaped that the elevator can be secured to a length of drill pipe merely by lowering the elevator in place over the drill pipe. Furthermore, in these preferred forms of the invention, a clamped length of drill pipe can be released from the elevator merely by supporting the length of drill pipe and then lowering the elevator such that the uppermost end of the clamped length of drill pipe automatically raises the collar and opens the jaws.

The elevator of this invention provides the important advantage that it operates to clamp and then to release lengths of drill pipe without any threaded connection between the elevator and the drill pipe. In this way, wear on the threads of the drill pipe is eliminated, and rapid clamping and unclamping of drill pipe by the elevator is made possible. The preferred forms of the invention described below provide the further advantage that they can be automatically locked and unlocked merely by lowering and raising the elevator as appropriate with respect to the clamped length of drill pipe. In this way, the speed with which drill pipe can be removed from a borehole is further increased and the manpower requirements for operating the elevator are reduced to a minimum.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

Turning now to the drawings, FIGS. 1 through 6 show various views of a first preferred embodiment of the elevator of this invention, and FIGS. 7 through 10 show the use of this embodiment in automatically clamping and then releasing a length of drill pipe.

Figure 2:
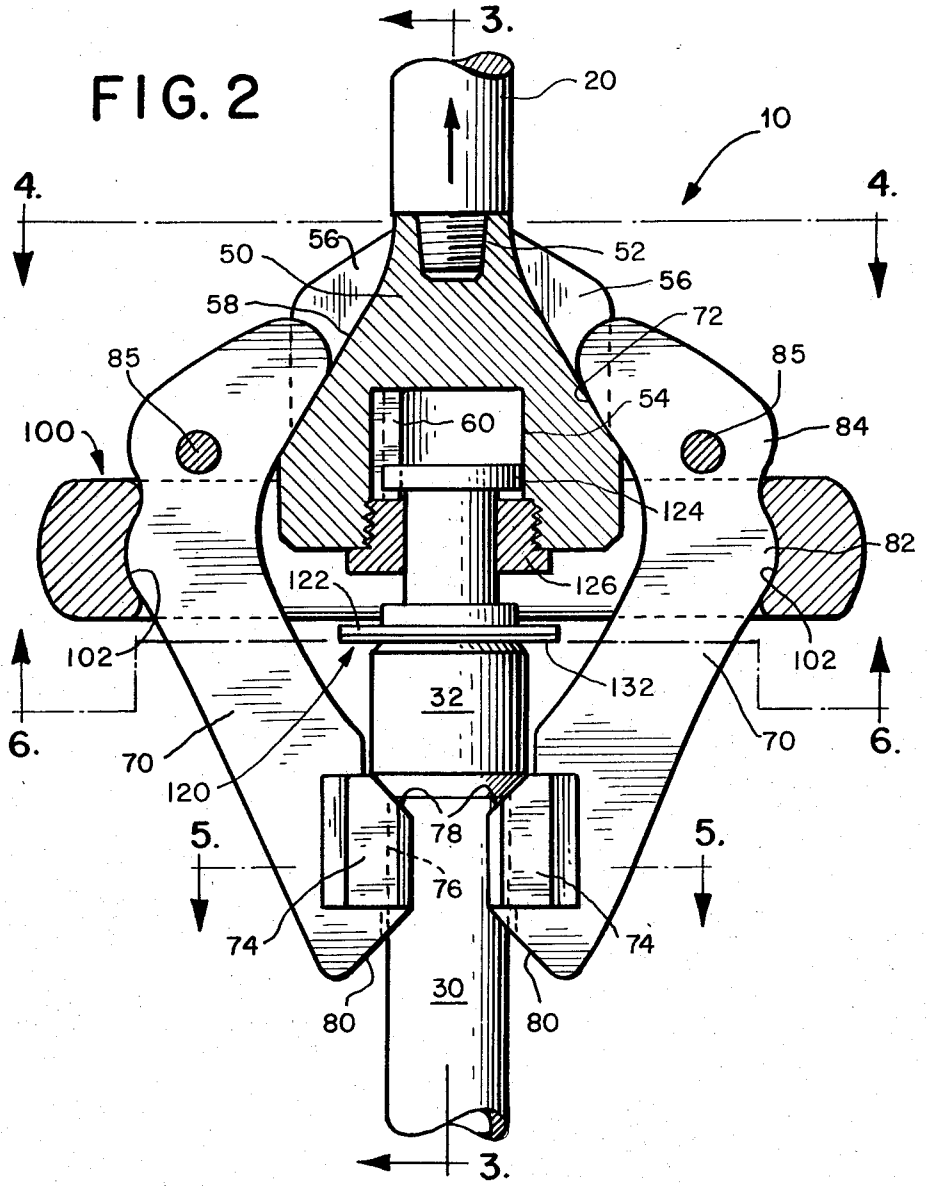
FIG. 2 is a sectional view taken along line 2—2 of FIG. 1.

As shown in FIGS. 1 through 6, the elevator 10 is mounted to a swivel saver sub 20 which is in turn suspended from a power swivel. The swivel saver sub 20 is a subassembly suspended from the swivel to save wear and tear on the swivel. When threaded and unthreaded many times, the worn swivel saver sub 20 can be replaced, saving the swivel from all but one threading and unthreading operation. The particular type of swivel used to suspend and rotate the elevator 10 does not form part of this invention and is therefore not shown. A wide range of swivels can be used to support the elevator of this invention, such as for example, that shown in my U.S. Pat. No. 4,314,611. As shown in FIG. 2, the elevator 10 is configured to clamp the box end 32 of the length of drill pipe 30, and in particular to bear against the shoulder 34 that forms the lower end of the box end 32.

The elevator 10 is made up of five major components: a cam body 50, two jaws 70, a collar 100, and a plate assembly 120. The following discussion will take up each of these components in sequence.

Figure 4:
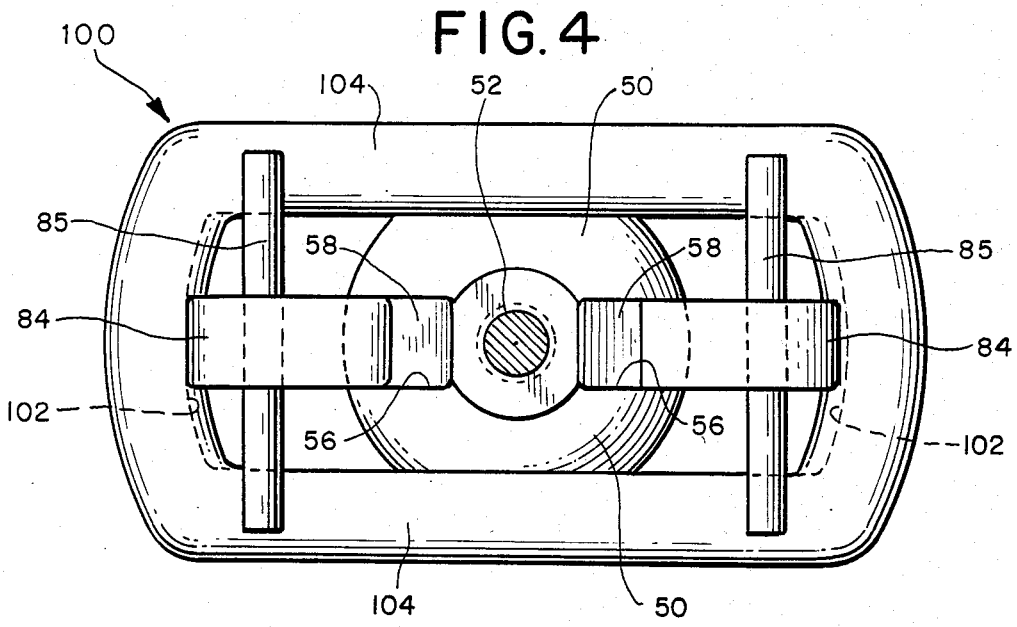
FIG. 4 is a sectional view taken along line 4—4 of FIG. 2.

In this embodiment, the cam body 50 is a steel member (which can be formed, for example, by forging or machining) which defines an attachment member 52 at its upper end. This attachment member 52 is threaded so as to receive the pin end of the swivel saver sub 20. The cam body 50 defines a lower cylindrical recess 54 which is aligned with the attachment member 52 along a support axis. A key 60 is rigidly secured to the cam body 50 along one side of the lower recess 54. The lowermost end of the lower recess 54 is threaded, as shown in FIG. 2. In addition, the cam body 50 defines two opposed grooves or recesses 56, the innermost surfaces of which define respective cam surfaces 58. As best shown in FIG. 4, these recesses 56 are symmetrically disposed with respect to the attachment member 52, and as shown in FIG. 2, each of the cam surfaces 58 slopes downwardly and outwardly.

Each of the jaws 70 includes a respective upper surface 72 which rides on a respective one of the cam surfaces 58. In addition, each of the jaws 70 includes an insert 74 which is secured to the lower end of the jaw 70. Each insert 74 defines a first arcuate clamping surface 76 shaped to fit against the length of drill pipe 30 and a second clamping surface 78 shaped to fit against the shoulder 34 of the length of drill pipe 30. The lowermost end of each of the jaws 70 is provided with an inwardly facing beveled surface 80 which travels in an uninterrupted slope from the lowermost tip of the jaw 70 to the lower edge of the respective insert 74. Each of the jaws 70 defines first and second shoulders 82, 84, respectively, at an intermediate position on the outer edge of the respective jaw. The first shoulder 82 is positioned below the cam surfaces 58 when the jaws 70 are in the position shown in FIG. 2. A pin 85 is positioned to pass through each of the jaws 70 and to extend outwardly on either side of the jaws 70. As will be explained in greater detail below, these pins 85 act as lugs and are provided as safety measures to prevent catastrophic failure of the elevator 10.

Figure 3:
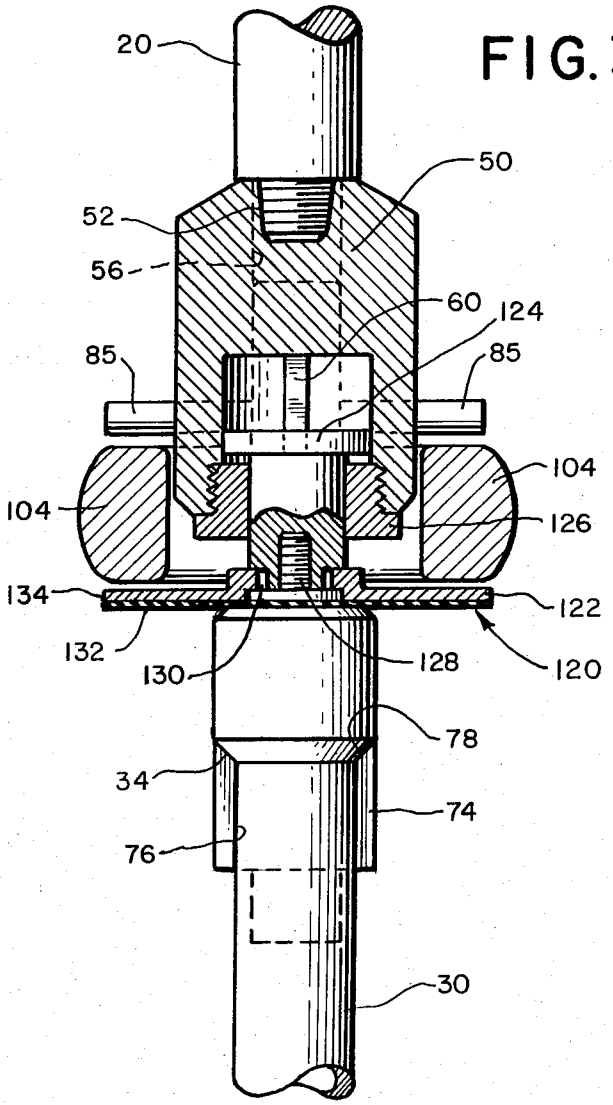
FIG. 3 is a sectional view taken along line 3—3 of FIG. 2.

The collar 100 completely surrounds the jaws 70 and the cam body 50, as shown in FIG. 4. The collar 100 defines two spaced, parallel, elongated sides 104 which are shaped to fit over the cam body 50. The collar 100 is not secured to the cam body 50, and the collar 100 is therefore free to move in the vertical direction with respect to the cam body 50. As best shown in FIG. 2, the collar 100 defines two recesses 102, each at an internal end surface of the collar 100. Each of the recesses 102 is shaped to provide a mechanical interlock with the first shoulder 82 of a respective one of the two jaws 70. This interlock allows each of the jaws 70 to pivot about the recesses 102 defined by the collar 100 such that the jaws 70 are pivotable with respect to both the collar 100 and the cam body 50. The second shoulder 84 of each of the jaws 70 extends outwardly above the collar 100 to provide a further surface preventing the jaws 70 from slipping through the collar 100. As best shown in FIGS. 3 and 4, the pins 85 extend outwardly from the jaws 70 so as to overlap the collar 100. According to the embodiment shown in FIGS. 3 and 4, during normal operation of the elevator 10, the pins 85 do not come in contact with the collar 100. They are provided merely as a safety feature to prevent the jaws 70 from falling through the collar 100 in the event of a failure of the interlock mechanism made up of the recesses 102 and the first shoulders 82.

The plate assembly 120 includes a plate 122 which is securely mounted to the lower end of a piston 124 by means of a bolt 128 and splines 130. The bolt 128 serves to fasten the plate 122 rigidly to the piston 124, and the splines 130 prevent relative rotation therebetween. The upper end of the piston 124 defines a slot sized to receive the key 60. The key 60 serves to index the angular position of the piston 124 and thereby of the plate 122. The piston 124 is held in position within the recess 54 of the cam body 50 by means of a threaded plug 126. This threaded plug 126 is threadedly engaged with the lower end of the recess 54 in order to capture the upper end of the piston 124 within the recess 54. A sliding fit is provided between the plug 126 and the center portion of the piston 124 such that the plate 122 is movable from a lower position, in which the upper end of the piston 124 rests against the plug 126, and an upper position, in which the plate 122 comes into contact with the plug 126. The plate 122 is provided with a cushioning layer 132 of a polymeric material such as polyurethane or nylatron on its lower surface. This cushioning layer 132 serves to protect the box ends of lengths of drill pipe 30 clamped in the elevator 10.

The materials and dimensions of the component parts of the elevator 10 should be chosen as appropriate for the desired application. For example, one preferred embodiment of the elevator 10 suitable for use with drill pipe having a diameter in the range of 5½ to 6½ inches utilizes jaws 70 formed of 3 inch plate steel and a collar 100 formed of 5 inch plate steel. In this embodiment, the cam body 50 is formed of forged steel. As will become apparent in connection with the following discussion of operation, the jaws 70 should be configured such that when the jaws 70 and the collar 100 are suspended from the cam body 50, the weight of the collar 100 tends to move the jaws 70 into a closed position. Furthermore, the jaws 70 should be configured such that when the collar 100 is supported by the plate 122, the jaws 70 pivot outwardly into an open position to release a clamped length of drill pipe. Although as indicated above, for the embodiment shown in FIGS. 3 and 4, during normal operation pins 85 do not contact collar 100, pins 85 can be positioned such that jaws 70 ride with pins 85 on collar 100 to pivot and release the length of drill pipe.

Figure 7:
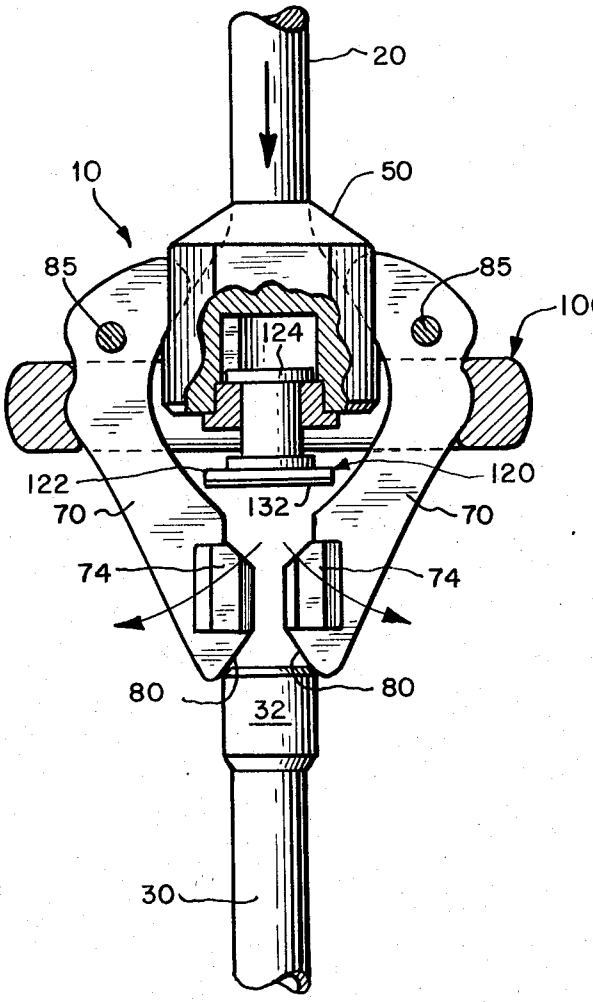
FIG. 7 is a sectional view taken in the plane of FIG. 2 showing the elevator positioned above a length of drill pipe.

Turning now to FIGS. 7 through 10, the operation of the preferred embodiment described above will now be discussed. FIG. 7 shows the elevator 10 suspended from the swivel saver sub 20 directly above a length of drill pipe 30. By way of example, the drill pipe 30 can be the upper end of a drill string which is being held in vertical position by means of slips (not shown).

Figure 8:
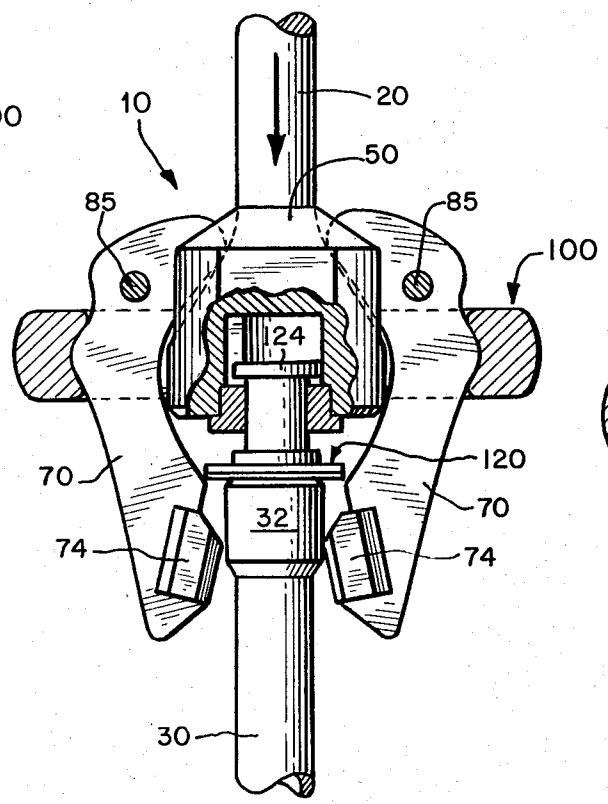
FIG. 8 is a sectional view taken in the plane of FIG. 7 showing the elevator partially lowered over the length of drill pipe.
Figure 9:
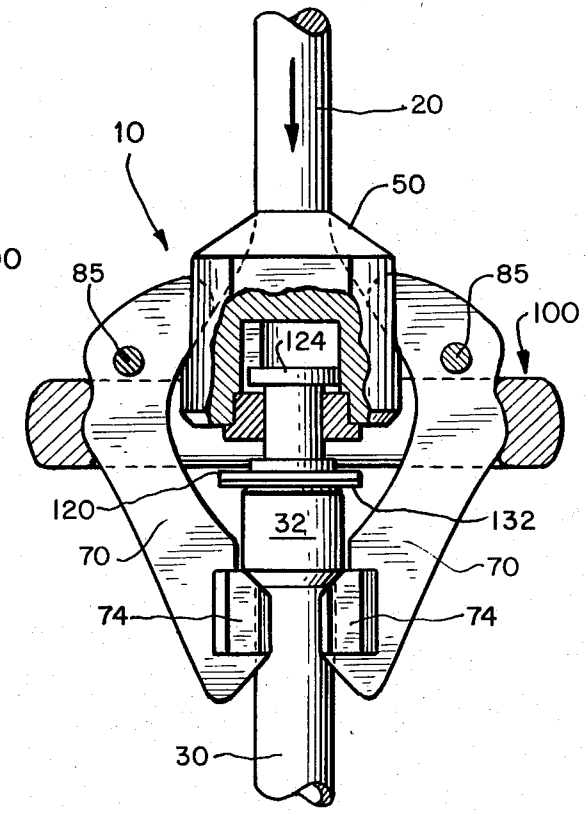
FIG. 9 is a sectional view taken in the plane of FIG. 7 showing the elevator positioned to clamp and support the clamped drill pipe.

As shown in FIG. 8, when the elevator 10 is lowered onto the box end of 32 of the length of drill pipe 30, the beveled surfaces 80 initially come into contact with the box end 32, thereby causing the jaws 70 to open. As the elevator 10 is lowered further, the jaws 70 are pushed open to allow the inserts 74 to pass over the box end 32.

Figure 5:
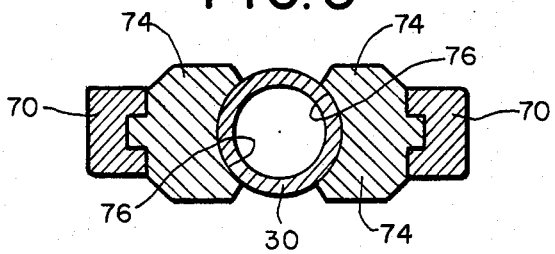
FIG. 5 is a sectional view taken along line 5—5 of FIG. 2.
Figure 6:
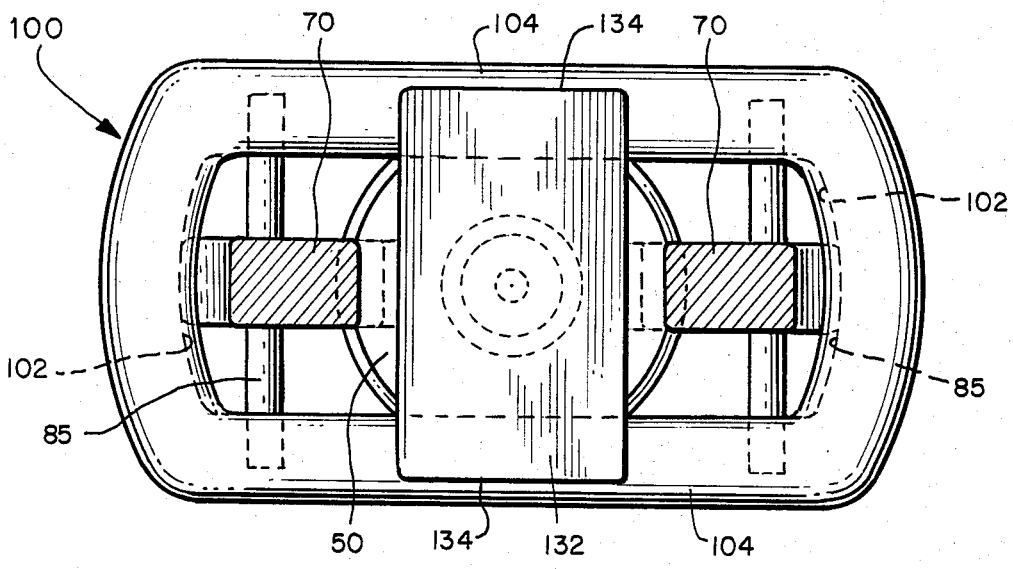
FIG. 6 is a sectional view taken along line 6—6 of FIG. 2.

FIG. 5 shows the position of the various components of the elevator 10 when the elevator 10 has been lowered sufficiently to allow the jaws 70 to close around the length of drill pipe 30. In this configuration, and drill pipe 30 is centered on a clamping axis, and is firmly clamped between the inserts 74, with large area contact between the cylindrical surface of the drill pipe 30 and the first clamping surfaces 76 of the inserts 74. Concurrently, FIG. 3 shows the large area contact between the shoulder 34 of the length of drill pipe 30 and the second clamping surfaces 78 of the inserts 74. In addition, large area contact is maintained between the upper surfaces 72 of the jaws 70 and the respective cam surfaces 58 of the cam body 50.

Once the elevator 10 is clamped onto the box end 32 of the length of drill pipe 30, upward forces applied via the swivel saver sub 20 can be used to lift the entire string of drill pipe. Because of the manner in which the jaws 70 are free to pivot about the collar 100, increased upward forces cause the cam surfaces 58 to exert increased outward forces on the upper surfaces 72 of the jaws 70, thereby causing the jaws 70 to exert increased clamping forces via the inserts 74 onto the length of drill pipe 30. The elevator 10 can then be used to lift the entire string of drill pipe until the uppermost length of drill pipe 30 is above the slips and the drill string has been again clamped in vertical position in the slips (not shown).

Once the drill string has been elevated as described above, make-up, break-out wrenches can be used to break the threaded joint between the uppermost length of drill pipe 30 and the adjacent length of drill pipe (not shown), and then the power swivel (not shown) can be used to rotate the elevator 10 to unscrew the uppermost length of drill pipe 30 from the adjacent length. Once the uppermost length of drill pipe 30 has been removed from the drill string, it can then be held in position in a transfer arm in the vertical position. The transfer arm does not form part of this invention and has not therefore been shown. However, transfer arms such as those shown in U.S. Pat. Nos. Re 26,284 and 4,303,270 may be used.

Once the uppermost length of drill pipe 30 has been firmly clamped in the transfer arm, the elevator 10 can then be lowered to automatically open the jaws 70. As the elevator 10 is lowered onto the box end 32 of the clamped length of drill pipe 30, the box end 32 comes into contact with the cushioning layer 132 positioned over the plate 122. As the elevator 10 is lowered further, the box end 32 urges plate 122 toward cam body 50 and eventually the collar 100 and the jaws 70 are supported on the plate 122 which is in turn supported by the box end 32 of the uppermost length of drill pipe 30.

Figure 10:
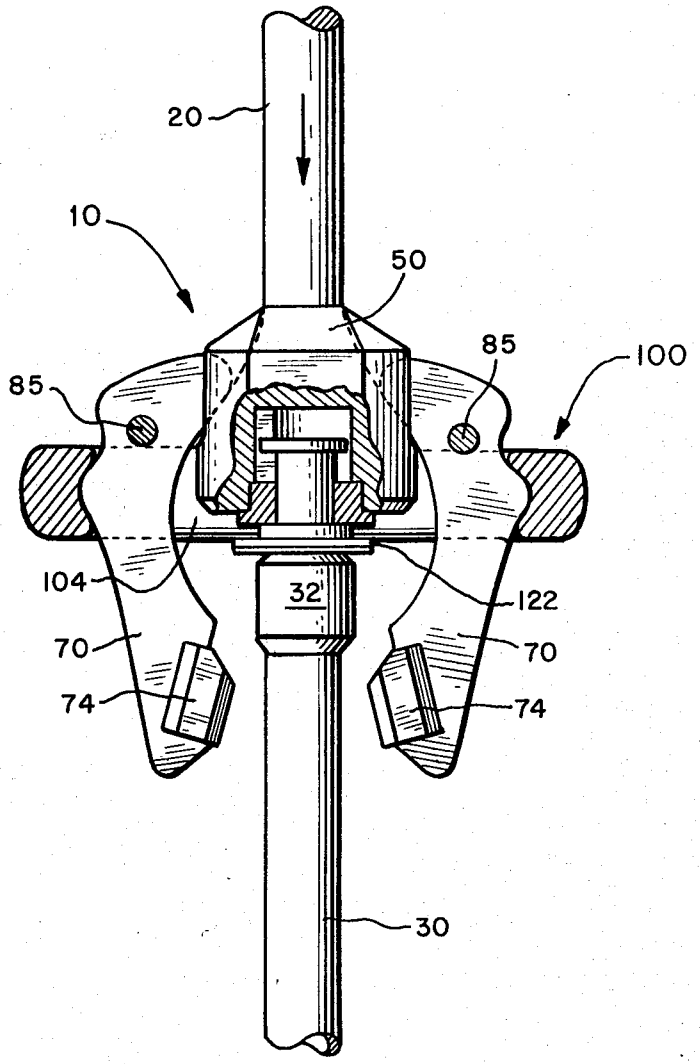
FIG. 10 is a sectional view taken in the plane of FIG. 7 showing the elevator in a lowered position in which the previously clamped length of drill pipe has been released.
Figure 1:
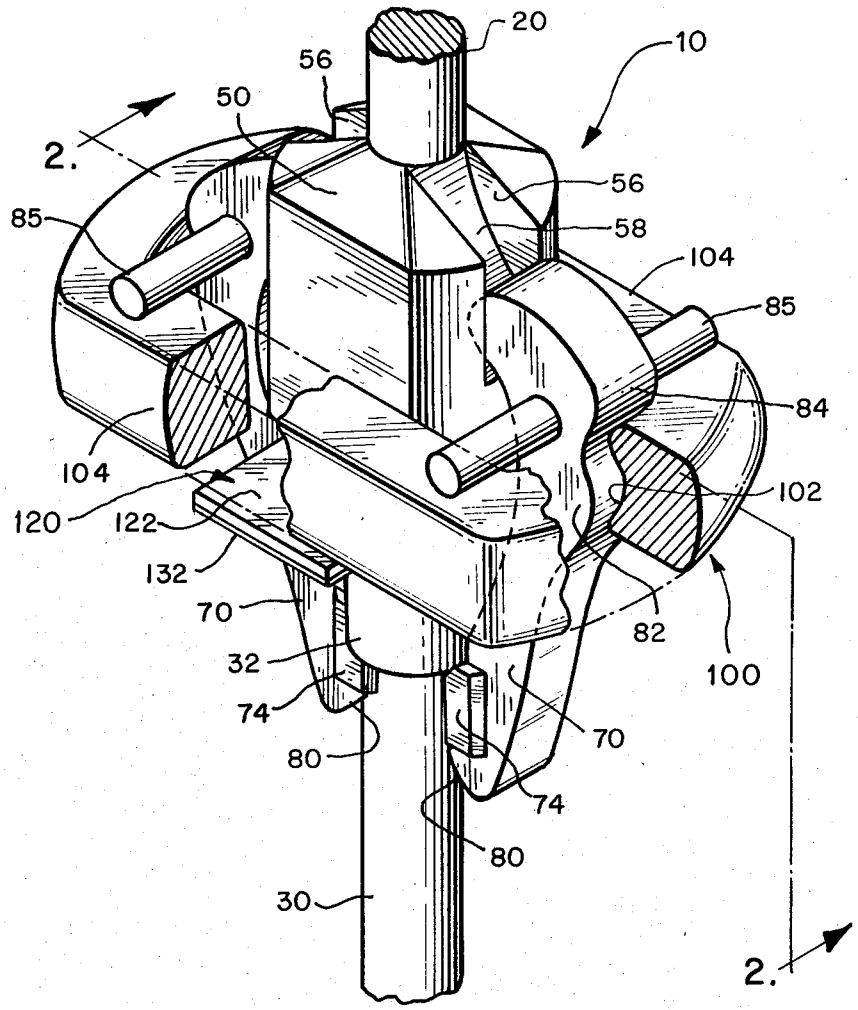
FIG. 1 is a perspective view of a presently preferred embodiment of the elevator of this invention.

As explained above, when the jaws 70 are supported by the collar 100, the jaws 70 automatically open, thereby releasing the length of drill pipe 30. Once the jaws 70 have been opened as shown in FIG. 10, the length of drill pipe 30 can then be removed from the elevator 10 by sliding it in the direction perpendicular to the plane of FIG. 10. As the box end 32 of the uppermost length of drill pipe 30 moves off of the clamping axis, it moves towards one of the two ends 134 of the plate 122. In this way, the box end 32 continues to support the plate 122, the collar 100, and the jaws 70 as it is moved out of the elevator 10. Once the box end 32 is completely out of the elevator 10, it passes off of the plate 122, and the elevator 10 is allowed to return to the orientation shown in FIG. 7, whereupon a subsequent length of drill pipe 30 can be clamped, raised and removed. In some embodiments, it may be desirable to design the piston 124 to slow the rate at which the jaws 70 fall.

Thus, the elevator of this invention operates without threaded connections between the elevator and the length of drill pipe. The elevator described above automatically opens as it is lowered onto the box end 32 of the uppermost length of drill pipe 30, and it can be automatically opened to release a clamped length of drill pipe merely by lowering the elevator 10 onto the supported drill pipe 30. Thus, the elevator of this invention is well adapted to provide rapid removal of drill pipe from a borehole, automatically, and without wear on the threaded connections of the drill pipe.

Of course, it should be understood that a wide range of changes and modifications to the preferred embodiments described above can be made without departing from the scope of this invention.

For example, the elevator of this invention can be embodied in three or four jaw elevators in addition to the two jaw elevator described above. Furthermore, the precise configuration of components such as the cam body, the collar, and the jaws as well, as the materials and fabrication techniques used to manufacture these components, can all be altered to suit the intended application. In some alternative embodiments, it may be desirable to pin the jaws to the collar to provide a mechanical interlock of the desired type. Such a pinning arrangement would substitute for the shoulder and recess arrangement described above.

As another example, the plate assembly 120 can be simplified so as to eliminate piston 124, threaded plug 126, bolt 128 and splines 130 in favor of merely fastening plate 122 to collar 100, e.g., by screws. In this event, the need for lower cylindrical recess 54 and key 60 in cam 50 is obviated.

Alternatively, plug 126 can be bolted to the underside of cam body 50, instead of being threadedly connected. With either a threaded or bolted plug, key 60 can be replaced with an appropriate keying between the lower shaft portion of piston 124 and plug 126. If the relative dimensions of the opening in collar 100, plate 122 and jaws 70 preclude plate 122 from partially or completely entering within collar 100 (for example if plate 122 is round), keying can be eliminated, even when using the piston arrangement. As another possibility, plate 122 can be fastened directly to the underside of collar 100.

It is therefore intended that the foregoing detailed description be regarded as illustrative rather than limiting, and that it be understood that it is the following claims, including all equivalents, which are intended to define the scope of this invention.

I claim:

1. An elevator for drill pipe, comprising:

at least two jaws, each jaw having a clamping surface shaped to support a length of pipe;

pivot means for urging the clamping surfaces of the jaws into contact with a length of pipe to be elevated, when the ends of the jaws distant from the clamping surfaces are urged away from the pipe;

elevator suspension and jaw activating means for suspending the elevator, for urging the ends of the jaws distant from the clamping surfaces away from the pipe, and in conjunction with the pivot means, for urging the clamping surfaces into contact with the pipe, when the elevator suspension and jaw activating means and the pipe are urged away from each other; and release means for urging the clamping surfaces away from the pipe when the elevator suspension and jaw activating means and the pipe are urged toward each other.

2. The invention of claim 1 wherein the elevator is so configured that upon lowering the elevator upon a vertical length of drill pipe held within the jaws of the elevator, the release means automatically urges the clamping surfaces away from the pipe, whereby to release the pipe.

3. The invention of claim 1 or 2 wherein the elevator is so configured that upon raising the elevator with a vertical length of drill pipe held within the jaws of the elevator, the elevator suspension and jaw activating means automatically urges the clamping surfaces toward the pipe, whereby to clamp firmly onto the length of pipe.

4. The invention of claim 1 or 2 wherein the elevator is so configured that upon raising the release means when no drill pipe is held within the jaws, the jaws open to receive a length of pipe.

5. An elevator for drill pipe, said elevator comprising:

a cam body having an attachment member and at least two spaced cam surfaces;

at least two jaws, each having an upper support surface in contact with a respective one of the at least two cam surfaces and a clamping surface shaped to support a length of pipe;

a collar;

means for engaging the collar on the jaws such that the weight of the collar is supportable on the jaws at a point below the cam surfaces and the jaws are pivotable with respect to the collar, the weight of said collar tending to cause the clamping surfaces of the jaws to approach one another to grip a length of pipe positioned therebetween; and means for raising the collar with respect to the cam body to cause the clamping surfaces to separate from one another to release a length of pipe positioned therebetween.

6. The invention of claim 5 wherein the attachment member defines a support axis and the at least two cam surfaces are symmetrically positioned with respect to the support axis.

7. The invention of claim 5 wherein each of the at least two cam surfaces forms the inner surface of a respective recess formed in the cam body.

8. The invention of claim 5 further comprising at least two pins, each positioned in a respective one of the jaws above the collar to prevent the respective jaw from falling through the collar.

9. The invention of claim 5 wherein the engaging means comprises:

a shoulder formed on each of the jaws adjacent the collar; and interlocking recesses formed in the collar to receive the shoulders in order mechanically to engage the jaws with the collar.

10. The invention of claim 5 wherein the raising means comprises:

a plate; and means for movably connecting the plate to the cam body such that the plate is movable between a lower position, in which the plate is situated beneath the collar, and an upper position, in which the plate supports the collar;

said plate positioned to contact a length of pipe centered in the jaws.

11. A self locking and unlocking elevator for drill pipe, said elevator comprising:

a cam body having an upper attachment member adapted to support the cam body, a lower recess aligned with the upper attachment member, and at least two cam surface defining grooves symmetrically disposed around the periphery of the cam body;

at least two jaws, each having an upper support surface disposed in a respective one of the cam surface defining grooves and a clamping surface shaped to hold a length of pipe on a clamping axis;

a collar disposed around the jaws;

means for mechanically interlocking the jaws with the collar such that the jaws are pivotable with respect to the cam body and the collar, the mechanical interlock means configured such that the jaws tend to close into a clamping position when the jaws and collar are suspended from the cam body, and the jaws tend to open into a release position when the jaws are supported by the collar;

a retaining shaft disposed to move longitudinally in the lower recess of the cam body; and a plate mounted to the retaining shaft below the collar and movable between an upper and a lower position, said plate passing across the collar between the jaws such that upward forces on the plate act on the collar to lift the collar;

the jaws, collar and cam body configured automatically to clamp a length of drill pipe positioned between the lower surfaces of the jaws when the plate is positioned in the lower position and the jaws and collar are suspended from the cam body, and automatically to release a clamped length of drill pipe when the plate is raised to the upper position.

12. The invention of claim 11 further comprising means for defining at least two lugs, each positioned on a respective one of the jaws above the collar, each shaped and dimensioned to prevent the respective jaw from passing through the collar in the event of a failure of the mechanical interlock means.

13. The invention of claim 11 wherein the attachment member is centered on the clamping axis and the at least two cam surface defining grooves are symmetrically disposed with respect to the clamping axis.

14. The invention of claim 11 wherein the mechanical interlock means comprises:

at least two recesses formed in inner surfaces of the collar in alignment with respective ones of the at least two jaws; and at least two protrusions, each positioned on a respective one of the jaws to fit within the respective recess and to create a mechanical interlock between the respective jaw and the collar.

15. An automatically locking and unlocking elevator for drill pipe, said elevator comprising:

a cam body having an attachment member and at least two spaced cam surfaces;

at least two jaws, each having an upper support surface in contact with a respective one of the two cam surfaces and a clamping surface shaped to support a length of pipe;

a collar;

means for engaging the collar on the jaws such that the weight of the collar is supportable on the jaws at a point below the cam surfaces and the jaws are pivotable with respect to the collar, the weight of said collar tending to cause the clamping surfaces of the jaws to approach one another to grip a length of pipe positioned therebetween;

means for automatically opening the jaws to receive a length of drill pipe when the elevator is lowered over the length of drill pipe to clamp the length of drill pipe; and means for automatically raising the collar and thereby opening the jaws to release the clamped length of drill pipe when the elevator is lowered with respect to the clamped length of drill pipe.

16. The invention of claim 15 wherein the raising means operates to move the jaws upwardly along the cam surfaces.

17. The invention of claim 15 wherein the raising means comprises:

a plate positioned between the jaws under the collar;

means for securing the plate to the cam body such that the plate is movable between a lower position, in which the plate is spaced from the collar, and an upper position, in which the plate supports the collar and the jaws.

18. The invention of claim 15 or 17 wherein the opening means comprises beveled inner surfaces, each defined by a respective one of the jaws below the respective clamping surface.

19. The invention of claim 15 or 17 wherein the engaging means comprises:

a shoulder formed on each of the jaws adjacent the collar; and interlocking recesses formed in the collar to receive the shoulders in order mechanically to engage the jaws with the collar.

20. The invention of claim 15 wherein the attachment member defines a support axis, and the at least two cam surfaces are symmetrically positioned with respect to the support axis.

21. The invention of claim 15 wherein each of the at least two cam surfaces forms the inner surface of a respective recess formed in the cam body.

22. The invention of claim 15 further comprising at least two pins, each positioned in a respective one of the jaws above the collar to prevent the respective jaw from falling through the collar.

23. The invention of claim 5 wherein the jaws are free of load bearing contact against one another in the region between the jaws and aligned with the collar.

24. The invention of claim 5 wherein the static weight of the collar and the jaws operates automatically to close the jaws when the jaws and collar are supported on the cam body.

* * * * *